United States Patent [19]

Calato

[11] Patent Number: 4,541,322

[45] Date of Patent: Sep. 17, 1985

[54] MUSICAL INSTRUMENT MALLET AND METHOD OF MAKING THE SAME

[75] Inventor: Joseph S. Calato, Ransomville, N.Y.

[73] Assignee: J. D. Calato Manufacturing Co., Inc., Niagara Falls, N.Y.

[21] Appl. No.: 494,940

[22] Filed: May 16, 1983

[51] Int. Cl.[4] ..... G10D 13/00

[52] U.S. Cl. ..... 84/422 S; 81/19; 273/67 R

[58] Field of Search ..... 84/254, 255, 324, 325, 84/404–407, 422 S, 459; 145/36; 273/67 R

[56] References Cited

U.S. PATENT DOCUMENTS

| | | | |
|---|---|---|---|
| 1,723,477 | 8/1929 | Farrar | 145/36 |
| 2,473,865 | 6/1949 | Dane | 84/404 |
| 2,799,199 | 7/1957 | Dane | 84/422 |
| 3,665,799 | 5/1972 | Hinger | 84/422 |
| 3,998,123 | 12/1976 | Hinger | 84/422 S |
| 4,307,647 | 12/1981 | Christian | 84/422 S |

*Primary Examiner*—Benjamin R. Fuller

*Attorney, Agent, or Firm*—Christel, Bean & Linihan

[57] ABSTRACT

A musical instrument mallet includes an improved arrangement by which the mallet playing head is attached to the mallet shaft. The mallet includes a shaft having handle and head portions, an apertured playing head, and a sleeve with flanges at opposite ends. The sleeve is fixedly attached to the head portion of the shaft and the playing head is tightly retained upon the sleeve between the end flanges. Steps included in making the mallet are forming one sleeve flange, placing the sleeve over the handle head portion, fixing the sleeve to the head portion, placing the playing head over the sleeve and forming the second flange to retain the playing head firmly on the sleeve and handle.

16 Claims, 6 Drawing Figures

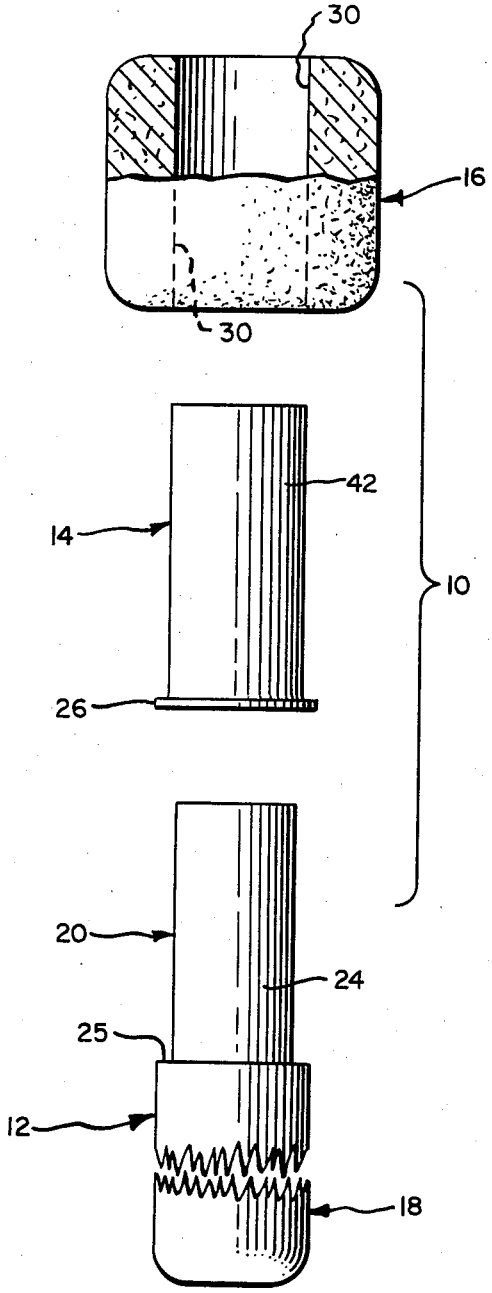
Fig. 1.
Fig. 2.
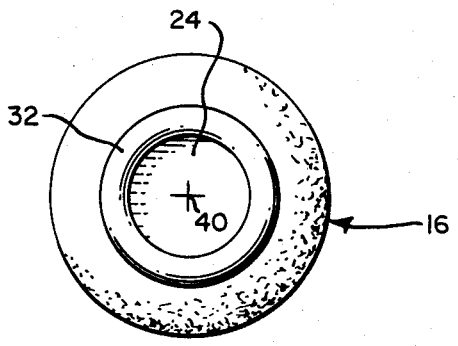
Fig. 3.
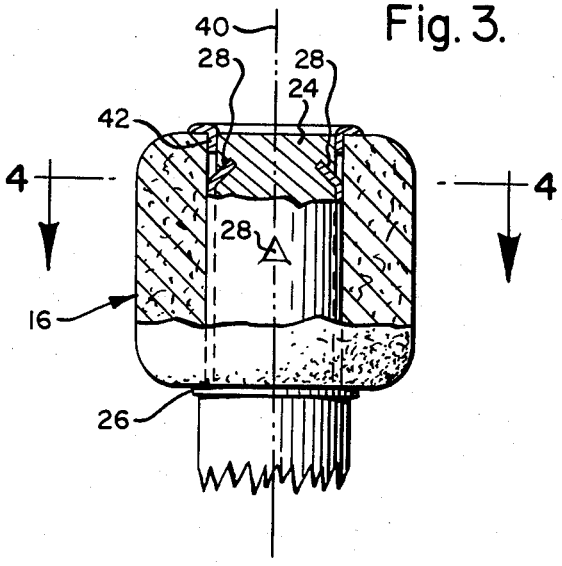
Fig. 4.
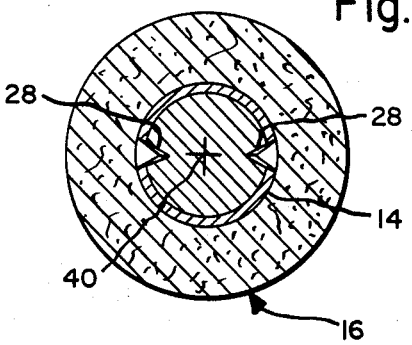
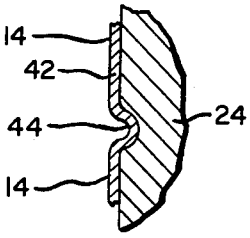
Fig. 5.
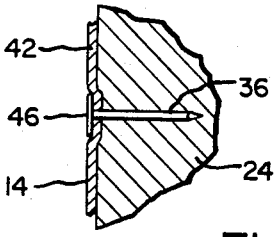
Fig. 6.

MUSICAL INSTRUMENT MALLET AND METHOD OF MAKING THE SAME

BACKGROUND OF THE INVENTION

This invention relates to musical instrument mallets, and is concerned in particular with the attachment of a mallet playing head to the mallet shaft.

A musical instrument mallet of the type to which this invention relates includes a playing head attached to an end of a slender shaft. The shaft typically includes a handle portion by which the mallet is held by a user and a head portion to which the playing head is attached. A problem associated with such prior art mallets is that during normal use, which may be characterized by vigorous pounding of the playing head against a drum, cymbal or similar instrument, the playing head is susceptible of breaking loose and separating from the mallet shaft.

SUMMARY OF THE INVENTION

It is, therefore, a primary object of this invention to provide a new and improved musical instrument mallet and method of making the same.

It is a more particular object of this invention to provide such a mallet wherein the playing head is not susceptible of breaking loose and separating from the handle shaft.

It is a further object of this invention to provide such a mallet which is simple in construction and convenient and economical to manufacture.

The present invention provides a musical instrument mallet and a method of making the same wherein the mallet comprises a shaft, an elongated sleeve and a playing head. The shaft has a handle portion and a head portion which includes an end section of reduced cross section. The elongated sleeve is closely accepted over and fixedly attached to the end section of the shaft head portion. The sleeve is provided with an annular flange at each of its two longitudinal ends, and the playing head is closely accepted about the sleeve and held thereupon between the flanges. In making the mallet according to the method of this invention a shaft and an elongated sleeve are provided, the shaft having a handle portion and a head portion, the head portion being provided with an end section of reduced cross section and the elongated sleeve being of such shape to be closely accepted over the end section. One end portion of the sleeve is formed into a first flange extending generally away from the longitudinal axis of the sleeve. The sleeve is then placed over the shaft end section and fixedly attached thereto. A playing head having a central through-opening of such size to be closely accepted about the sleeve is then placed over the sleeve. The sleeve end portion opposite the first flange is then formed into a second flange extending generally away from the longitudinal axis of the sleeve whereby the playing head is retained on the sleeve between the first and second flanges.

The foregoing and additional advantages and characterizing features of the present invention will become clearly apparent upon a reading of the ensuing detailed description together with the included drawing wherein:

BRIEF DESCRIPTION OF THE DRAWINGS

FIG. 1 is an exploded view of a musical instrument mallet according to the present invention with the playing head shown partially cut-away and with a portion of the handle removed;

FIG. 2 is an axial end view of the mallet of FIG. 1 shown in assembled condition;

FIG. 3 is an elevational view of the head end of the mallet of FIG. 1 shown partially in section;

FIG. 4 is a sectional view taken about on line 4—4 in FIG. 3;

FIG. 5 illustrates one alternative means for attaching the sleeve to the end section of the mallet shaft; and FIG. 6 illustrates another alternative means for attaching the sleeve to the end section of the mallet shaft.

DETAILED DESCRIPTION OF THE ILLUSTRATED EMBODIMENTS

FIG. 1 illustrates a mallet of the present invention. The mallet, generally designated 10, comprises a shaft 12, an elongated sleeve 14 and a playing head 16. The shaft 12 includes a handle portion 18 by which the mallet is held or grasped by hand during use and a head portion 20 to which the playing head is attached. The shaft is in the shape of a rod and is formed from a suitable material, such as wood, for supporting the playing head during normal use of the mallet. The shaft head portion 20 is formed to include an end section 24 of reduced cross-section extending axially inwardly from the end of shaft 12 to an annular surface defining a shoulder 25.

Referring now to FIGS. 2 and 3, the sleeve 14 is made of suitable material, preferably metal, and is in the form of an elongated, hollow, thin-walled cylinder of such size to fit closely upon the end section 24 of the shaft head portion. In other words, the inner diameter of sleeve 14 is slightly larger than the outer diameter of shaft end section 24. As best shown in FIG. 3, one of the ends of the sleeve abuts, or seats against, the shoulder 25 of the shaft head portion. The sleeve includes at one of its longitudinal or axial ends a first annular flange 26 and at the other of its longitudinal or axial ends a second annular flange 32. Each flange extends generally away from the longitudinal axis, indicated 40, of the sleeve. In particular, each flange 26,32 has a length measured outwardly from the body of sleeve 14 which is relatively short but of sufficient length to engage the body of playing head 16 in a manner adequate to hold or maintain head 16 on shaft 12 during use of the mallet. Each flange 26,32 defines with the adjacent surface of the body of sleeve 14 an angle, and in the mallet shown that angle is about ninety degrees.

The sleeve 14 has a wall 42 extending between its longitudinal ends and the wall is provided with anchoring means within the form of detent means which are embedded in the end section 24 for fixedly attaching the sleeve to the shaft. As shown in FIGS. 3 and 4, the detent means are in the form of a plurality of triangular barbs 28,28 extending inwardly from wall 42 and having apexes generally pointed toward the longitudinal axis 40 of the sleeve.

The playing head 16 is shown in FIGS. 1–3 of suitable mallet head material such as felt or rubber and is generally solid cylindrical in shape. A central, axial through-opening or bore 30 is provided in the playing head 12 and is of such size enabling the head 12 to be closely or tightly fitted on the sleeve 14. In other words, the diameter of bore 30 is slightly larger than the outer diameter of sleeve 14.

The playing head 16 is positioned on the sleeve 14 so that one side of the playing head, i.e. the lower side as viewed in FIG. 3, abuts the sleeve flange 26 and the opposite side, i.e. the upper side as viewed in FIG. 3, abuts the flange 32. The head 16 is thereby firmly retained on the head between the two flanges 26 and 32. Preferably, the flanges 26 and 32 are in compressive engagement with the opposite sides of the playing head so that the head is tightly held between the flanges and cannot slide along the length of the sleeve.

In carrying out the method of this invention, first the shaft 12 including handle portion 18 and head portion 20 is provided. Shaft 12 is formed, such as by lathe turning of wood or molding of plastic, in a conventional manner. Then the hollow cylindrical sleeve 14 is provided, and initially the sleeve is without flanges or detent means. One axial end portion of the sleeve 14 is formed such as by bending, shaping or any suitable metal forming techniques to include the first annular flange 26. Then the sleeve 14 is placed over the shaft section 24 until the end portion of the sleeve having the first flange 26 abuts the shoulder 25. The sleeve is then fixedly attached to the shaft section 24 in a single operation by placing the assembly in a punch press and punching barbs 28,28 in the sleeve wall 42 to embed or otherwise engage them in the shaft section 24. In this case shaft section 24 could be of wood. The playing head 16 provided with central through passage or opening 30 is then placed over the sleeve so as to abut the flange 26. The portion at the end of sleeve 14 opposite the first flange 26 is subsequently formed in a manner similar to that for flange 26 to form the second flange 32. Flange 32 is formed in a manner such that the playing head 16 is retained on the sleeve 14 between the first and second flanges 26 and 32. To prevent the head 16 from sliding along the length of the sleeve, the second flange is preferably formed by rolling the associated sleeve end portion into the playing head.

While the present invention has been described in preferred embodiments, it will be understood that still further modifications and substitutions can be made without departing from the spirit and scope of the invention. For example, instead of the triangular-shaped barbs 28,28 described above, other means may be employed to attach the sleeve 14 to the end section 20 of the shaft head portion. As illustrated in FIG. 5, a plurality of cup-shaped indentations 44 can be formed in the sleeve wall 42 so as to be embedded in the end section, and as illustrated in FIG. 6, the shank of a headed fastener 36, such as a nail or staple, can be embedded in the end section through a defined aperture 46 in the wall so as to hold the sleeve against the shaft between the end section 20 and the head of the fastener 36. The wall aperture 46 required for the means of attachment shown in FIG. 6 can be formed by a suitable means, such as a drill or an impact tool. Preferably, and as shown in FIG. 6, the fastener 36 is driven far enough into the sleeve wall so that the exposed surface of the fastener head is flush with the outer surface of the sleeve wall to facilitate the placement of the playing head over the sleeve. Pneumatic stapling can be used.

It is therefore apparent that the present invention accomplishes its intended objects. While embodiments of the present invention have been described in detail, this is for the purpose of illustration, not limitation.

I claim:

1. A musical instrument mallet comprising:

a shaft having a handle portion and a head portion including an end section;

an elongated deformable thin-walled sleeve closely accepted upon said end section of said shaft head portion, provided with anchor means protruding from said sleeve into said head portion end section and which anchor said sleeve directly to said end section, and having a first flange at one longitudinal end of said sleeve and a second flange at the other longitudinal end of said sleeve, said flanges extending generally away from the longitudinal axis of said sleeve; and a playing head closely accepted about said sleeve so as to cover said anchor means and held thereabout between said flanges of said sleeve, said flanges being in compressive engagement with the opposite sides of said playing head whereby said playing head is tightly held upon said shaft head portion between said flanges.

2. A mallet as defined in claim 1 wherein said anchor means comprises detent means including at least one barb.

3. A mallet as defined in claim 1 wherein said anchor means includes at least one cup-shaped indentation.

4. A mallet as defined in claim 1 wherein said anchor means defines an aperture and further including a headed fastener including a shank, the shank being received through the aperture of anchor means and being embedded in said end section of said shaft head portion.

5. A mallet as defined in claim 1 wherein said sleeve includes a wall between the two longitudinal ends thereof, said wall being provided with an aperture, and further including a headed fastener including a shank being received through the sleeve aperture and being embedded in the end section of the shaft head portion to fixedly attach the sleeve to the shaft.

6. A mallet as defined in claim 1 wherein the head portion of the shaft defines a shoulder, the end section extends from the shoulder and one of the longitudinal ends of the sleeve abuts the defined shoulder of the head portion.

7. A mallet as defined in claim 6 wherein said shaft is cylindrical in shape and said end section is a reduced-diametered portion of said shaft.

8. A mallet as defined in claim 7 wherein the said section and the remainder of said shaft are coaxially aligned.

9. A musical instrument mallet comprising:

a playing head having a longitudinal opening;

an elongated deformable thin-walled sleeve being closely received endwise through said playing head opening and formed to include two flanges between which said playing head is held firmly upon said sleeve, each flange being located at a longitudinal end of said sleeve opposite the other flange and in compressive engagement with said playing head; and a shaft including a handle portion and a head portion, said head portion including a shoulder and an end section extending from the shoulder, said end section being closely received within said sleeve and fixedly attached thereto, said sleeve being positioned upon said end section so that one of the longitudinal ends of said sleeve abuts said shoulder and provided with anchor means covered by said playing head and protruding from said sleeve into said end section for fixedly attaching said sleeve directly to said end section.

10. A method of making a musical instrument mallet comprising the steps of:

forming a shaft having a handle portion and a head portion, said head portion defining a shoulder and an extended end section;

providing an elongated thin-walled sleeve of such shape to be closely accepted over said end section of said head portion;

forming an end portion of said sleeve into a first flange extending generally away from the longitudinal axis of said sleeve;

placing said sleeve over said end section;

fixedly attaching said sleeve to said end section;

providing a playing head having a central through-opening of such size to be closely accepted over said sleeve;

placing said playing head over said sleeve; and forming an end portion of said sleeve at the end opposite said first flange into a second flange extending generally away from the longitudinal axis of the sleeve whereby said playing head is firmly retained on said sleeve between said first and second flanges.

11. A method as defined in claim 10 wherein said step of fixedly attaching said sleeve to said end section includes the step of embedding a portion of said sleeve within said end section.

12. A method as defined in claim 10 wherein said sleeve includes a wall between the two ends thereof and said step of attaching said sleeve to said head portion is preceded by forming an aperture in said sleeve wall and wherein said step of fixedly attaching includes the steps of inserting the shank of a headed fastener through said sleeve apertures; and embedding the fastener shank in said end section whereby said sleeve is held against the shaft between said end section and the head of the fastener and wherein the step of placing said playing head over said sleeve covers the head of the fastener with said playing head.

13. A method as defined in claim 10 wherein said sleeve includes a wall between the two ends thereof and said step of fixedly attaching said sleeve to said end section includes forming at least one detent in the sleeve wall in a manner such that said detent projects into said end section of said head portion.

14. A method as defined in claim 10 wherein said step of placing said sleeve over said end section positions one end of said sleeve in abutting engagement with said shoulder.

15. A method as defined in claim 10 wherein said step of placing said playing head over said sleeve positions one side of said playing head in engagement with the first sleeve flange, and said step of forming said sleeve end portion to form the second flange positions the second flange in engagement with a side of said playing head opposite said one side.

16. A method as defined in claim 10 wherein said step of forming a sleeve end portion to form a second flange includes the step of rolling the end portion of the sleeve into the playing head so that the playing head is tightly held between the two flanges.

* * * * *